United States Patent [19]

Augustin

[11] Patent Number: 4,528,528

[45] Date of Patent: Jul. 9, 1985

[54] WAVEGUIDE POLARIZATION COUPLING

[75] Inventor: Eugene P. Augustin, Orlando, Fla.

[73] Assignee: Boman Industries, Downey, Calif.

[21] Appl. No.: 364,906

[22] Filed: Apr. 2, 1982

[51] Int. Cl.[3] ..... H01P 1/165

[52] U.S. Cl. ..... 333/21 A; 343/786

[58] Field of Search ..... 333/21 R, 21 A, 249, 333/254; 343/756, 786

[56] References Cited

U.S. PATENT DOCUMENTS

| | | | |
|---|---|---|---|
| 2,548,821 | 4/1951 | Riblet et al. | 343/786 X |
| 2,742,612 | 4/1956 | Cohn | 333/21 R |
| 2,880,399 | 3/1959 | Murphy | 333/21 R X |
| 3,681,714 | 8/1972 | Terakawa | 333/254 X |
| 4,168,504 | 9/1979 | Davis | 343/786 |
| 4,414,516 | 11/1983 | Howard | 333/21 A |

*Primary Examiner*—Paul Gensler

*Attorney, Agent, or Firm*—Shlesinger Arkwright Garvey & Fado

[57] ABSTRACT

A rotatable coupling probe is disposed within a waveguide housing to provide accurate rotation of the plane of polarization between a rectangular input waveguide element and a circular output waveguide element, the rotation being controlled by an external sensing switch and motor unit connected to the probe.

14 Claims, 2 Drawing Figures

WAVEGUIDE POLARIZATION COUPLING

BACKGROUND OF INVENTION

This invention relates to waveguide coupling devices for high frequency waveguides, such as used for microwaves, and particularly to a waveguide coupling which rotates the plane of polarization of the waves transmitted through the waveguide.

Many different arrangements have been used to rotate the plane of polarization of a transmitted high frequency wave. For example, couplings have been used which have a stack of similar elements, each with a slot corresponding to the waveguide cross section which are successively stepped to effect rotation. It has been necessary to use substantial gearing and interconnecting mechanisms in such an arrangement for rotating the plane of polarization in constant even increments through the successive slots in these devices. The coupling is operated by an external motor or other actuating means which is bulky, and the devices are generally limited to noncontinuous rotations.

Another type of device which is of interest with respect to rotation of the plane of polarization is disclosed in the patent to Moore U.S. Pat. No. 3,708,767 which shows a rotary adjusting means for polarization orientation. The Heeren U.S. Pat. No. 3,622,921 also discloses a polarization rotator which uses a dielectric disc powered by an external motor. The patent to Hudspeth 4,060,781 uses a stepping motor system for adjusting rotational angle of a quarter wave plate.

However, none of these devices permits the precise rotation of the plane of polarization in ninety degree increments, nor do they also provide for both continuous or incremental rotation. There is also a need for a simply constructed polarization rotation switch that will not be bulky and too costly.

SUMMARY OF THE INVENTION

According, it is a general object of this invention to provide an improved polarization coupling for use in waveguides, and particularly in microwave transmission systems.

A feature of this invention is to provide a waveguide coupling in which the plane of polarization can be readily rotated in precise increments by a compact unit.

Another feature of this invention is to provide a rotary coupling for waveguides in which rotation of the plane of polarization can be effected without requiring movement or rotation of the coupled waveguide elements.

A further feature of this invention is the provision of a polarization coupling in which there can be precise designation and control of the specific polarization orientation.

It is another feature of this invention to provide a polarization coupling switch which permits the polarization rate to be accurately controlled.

A still further feature of this invention is to provide a microwave waveguide coupling between a rectangular waveguide input element and a circular waveguide output element which has precise ninety degree accuracy.

A still further feature of this invention is to provide a microwave polarization switch which is readily controlled by an external power source.

A still further feature of this invention is to provide a waveguide coupling which is impedance matched for all orientations of polarization.

A still further feature of this invention is to provide a waveguide coupling for a rectangular waveguide input and a circular waveguide output which is capacitively coupled with respect to the rectangular waveguide element and has a quasicapacitive magnetic loop coupling with respect to the circular waveguide element.

It is another feature of this invention to provide a waveguide coupling element which is compact and self-contained and has the ability to be readily adjusted for a specific polarization.

A still further feature of this invention is to provide a waveguide polarization switch in which all impedance matching elements are contained within the basic probe assembly within the circular waveguide.

It is a still further feature of this invention to provide a rectangular to circular waveguide coupling switch assembly in which the probe in the rectangular waveguide is insensitive to polarization orientation, and the probe within the circular waveguide designates a specific polarization depending upon its orientation.

DESCRIPTION OF THE INVENTION

Figure 1:
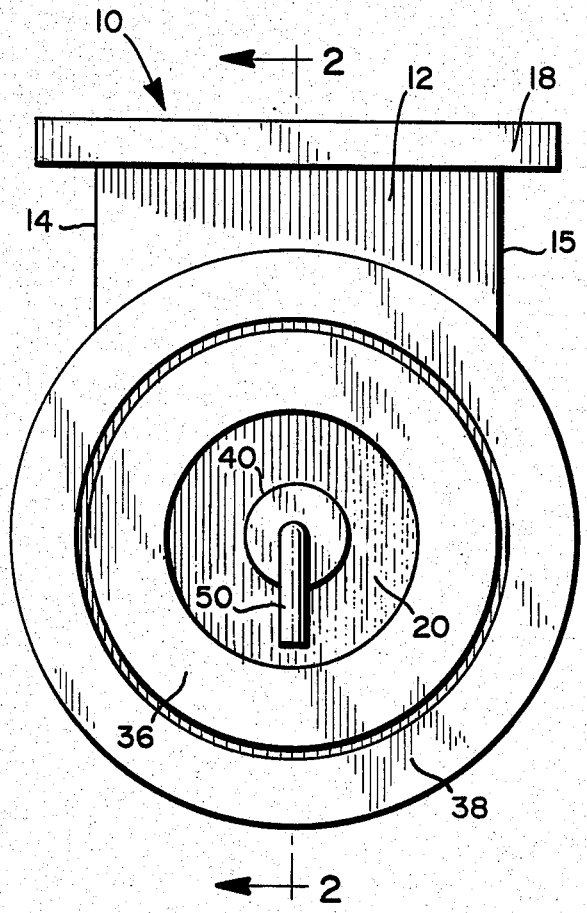
FIG. 1 is a face view of the waveguide polarization coupling.
Figure 2:
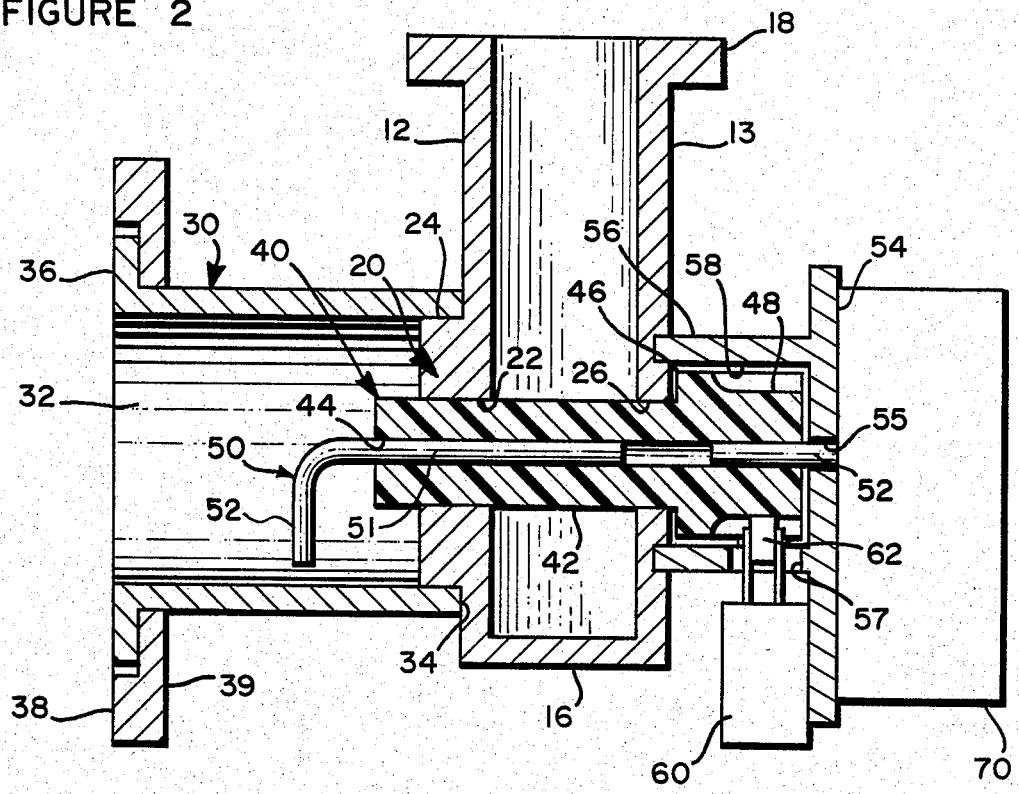
FIG. 2 is a sectional view taken along 2—2 of FIG. 1.

Referring to FIGS. 1 and 2, the rectangular waveguide generally indicated at 10 has front and rear faces 12 and 13 respectively, and side faces 14 and 15. The bottom end plate 16 of the waveguide closes the waveguide, and coupling flange 18 at the top of the rectangular waveguide permits it to be coupled to matching waveguide sections.

The separator wall section, generally indicated at 20, is disposed adjacent the rectangular waveguide bottom end plate 16, and provides for transition of the high frequency waves from the end of the rectangular waveguide. It has an annular coupling opening 22 extending therethrough and a circular outer annular support surface 24. Immediately opposite and in line with the annular coupling opening 22 of the separator section 20 is a coupling rear wall opening 26 disposed within the rear wall 13 of the rectangular waveguide.

A circular waveguide, generally indicated at 30, is attached to the lower end of the rectangular waveguide 10 adjacent the bottom end plate 16 and is mounted on the circular outer support surface 24 of the separator section 20. It has an internal circular surface 32 and its coupling end 34 is mounted on the annular surface 24. The far end of the circular waveguide element has an outwardly extending flange 36 on which a polarization swivel flange 38 is mounted.

The coupling probe assembly, generally indicated at 40, consists of a cylindrical dielectric coupling support section 42 which has an internal axial probe support bore 44. The cylindrical section extends through and is mounted in the circular openings 22 and 26. An enlarged annular shoulder 46 is disposed at the other end of the coupling probe and engages the rear face 13 of the rectangular waveguide element immediately adjacent the waveguide rear wall opening 26. The enlarged shoulder section has four equally-spaced recessed cam surfaces 48 which are spaced at a precise ninety degrees from each other.

An L-shaped metallic probe element 50 having an elongated support and conductor section 51 is firmly inserted within the probe support bore 44 of the probe assembly of the dielectric section 42. The short leg 52 extends into the circular waveguide and is disposed in a plane perpendicular to the axis of the circular waveguide. The metallic probe can be rotated within the bore 44 to provide any desired angular rotation, and in addition, the distance of the leg 52 from the separator section 20 can be varied by pressing the probe 50 further into the bore 44 of the dielectric support. At the rear end of the probe assembly is a connecting motor drive element 53 which extends outwardly from the annular channel 44 to engage a motor drive. The end of the elongated support section 51 does not extend through the rear wall 13 of the rectangular waveguide, but is positioned short of the rear wall.

A motor support plate 54 has a central opening 55 through which the motor engaging drive element extends. The motor support plate 54 is part of a connecting housing assembly 56 which has at the bottom thereof an access opening 57. The interior of the housing 56 forms a circular interior cavity 58 which surrounds the drive and control end of the coupling probe assembly.

A control switch 60 having a follower button 62 is electrically connected to the control motor assembly 70. The motor is a clock motor having reduction gears to which the drive element 53 is mechanically connected. The follower button acts as a sensing means by following the circular surface of the rear shoulder section 46 and will ride along the surface until it encounters one of the depressed cam surfaces 48. Movement of the button will activate the rocker switch 60 and will interrupt the motor circuit. This will cut off power to the motor and hold the coupling probe 40 at that exact position.

It should be noted that the probe assembly central section 42 within the rectangular waveguide does not affect the impedance characteristics of the waveguide. The switch 60 can be overridden by appropriate circuitry, not shown, to provide for continuous rotation of the probe assembly 40.

OPERATION

The polarization waveguide assembly receives the high frequency waves, such as microwaves, through the rectangular waveguide and they are transmitted through the separator section 20 and carried out of the waveguide coupling assembly through the short circular waveguide element 30. The circular waveguide element is oriented perpendicular to the rectangular waveguide element. The probe assembly 40 with its dielectric coupling probe support coupling section 42 provides for polarization of the transmitted waves in the circular waveguide output element. The metallic coupling probe 50 acts as a loop coupling in the circular waveguide and as a capactive coupling in the rectangular waveguide.

The L-shaped metallic coupling probe 50 can be rotated within the dielectric probe support to provide for desired angular orientation of the waves with respect to the waveguide and to the angular disposition of the 90° radially spaced cam surfaces 48.

The dielectric probe support section 42 has a circular section 44 within the waveguides, with its central axis mounted along the axis of the circular waveguide. It is symmetrically mounted with respect to the rectangular waveguide element. Inasmuch as the probe support has a mounting at the central portion of the rectangular waveguide, it has an axis of symmetry about the probe so that rotation of the probe will not bring about a change in configuration of the rectangular waveguide element. Thus it is impedance matched and is independent of orientation of the probe in that waveguide and is impedance matched for all positions.

With regard to rotation of polarization within the circular output waveguide element, the rocker switch and cam assembly provide for movement and control in precise ninety degree steps, inasmuch as the four cam step surfaces 48 are each precisely ninety degrees apart, and are cut in the outer surface of the dielectric probe support behind the annular shoulder 46. The rocker switch 60 can be overridden to provide continuous or inch-moving of the polarization. Polarization rate is limited only by the speed of the motor, and can be changed unidirectionally or bi-directionally according to the motor characteristics. The high gear ratio motor permits instantaneous stopping to prevent over-travel of the polarization orientation probe.

The swivel flange assembly 36,38 permits the setting of orientation of the entire assembly with respect to the unit to which the waveguide coupling assembly is to be connected. However, it is possible to also accomplish this, as mentioned previously, by movement of the L-shaped metallic coupling probe 50 within the dielectric probe support.

One of the big advantages of this probe assembly is that it can be made to operate in precise ninety degree steps because of the cam and rocker switch assembly.

The application of voltage to the motor causes probe support assembly 40 to rotate, thus rotating the coupling 50 and the polarization of the high frequency wave electric vector.

While the invention has been described in connection with different embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains, and as may be applied to the essential features hereinbefore set forth and fall within the scope of the invention or the limits of the appended claims.

What is claimed is:

1. A waveguide polarization coupling assembly, comprising:

(a) a rectangular input waveguide having a closed end, (b) a circular output waveguide adjacent and connected to the rectangular input waveguide at one end and having its longitudinal axis perpendicular to and intersecting with that of the rectangular waveguide element, adjacent the closed end, (c) a separator wall section disposed at the end of the circular waveguide, forming a common wall between the waveguide elements, (d) a non-metallic dielectric coupling probe support rotatably mounted and extending across the rectangular waveguide along an extension of the axis of the circular waveguide and rotatably supported at one end by the separator plate wall section, and at the other rear end by the opposed rear wall of the rectangular waveguide, both of which it extends through, (e) mechanical means connected to the rear end of the dielectric support means for precisely rotating the coupling probe support through an angle of 90°;

(f) the dielectric support means having a central bore which extends in alignment with the axis of the circular waveguide, (g) a metallic waveguide coupling probe having an elongated support section which is disposed within the bore of the rotatable coupling probe and in turn supports a rotatable short leg which is disposed within the circular waveguide and rotates in a plane extending perpendicular to the central axis of the circular waveguide and spaced from the separator wall section for precisely rotating the polarization of the transmitted wave within the circular waveguide without affecting polarization within the rectangular waveguide, and (h) the probe being rotatably and longitudinally adjustable with respect to the dielectric coupling probe support to provide a capacitive coupling in the rectangular waveguide, and quasi-capacitive magnetic loop coupling in the circular waveguide.

2. The waveguide polarization coupling assembly as set forth in claim 1, wherein:

(a) the mechanical means includes sensing means associated with the dielectric coupling probe support for precisely controlling the orientation of the probe.

3. The waveguide polarization coupling assembly as set forth in claim 1, wherein:

(a) the mechanical means includes a switch and motor assembly mounted externally of the waveguide element for controlling rotating of polarization.

4. The waveguide polarization coupling assembly as set forth in claim 1, wherein:

(a) the circular output waveguide includes a swivel flange to allow orientation of the polarization with respect to the member to which the circular waveguide output is to be connected.

5. The waveguide polarization coupling assembly as set forth in claim 1, wherein:

(a) the dielectric coupling probe support for the probe includes an external control section immediately adjacent the rectangular waveguide for imparting rotation to the support member, and (b) the external section of the dielectric probe support member also includes means for indicating angular attitude of the probe.

6. The waveguide polarization coupling assembly as set forth in claim 5, wherein:

(a) the motor assembly includes a clock motor with integral reduction gears connected to the external control section of the dielectric coupling probe support.

7. The waveguide polarization coupling assembly as set forth in claim 5, wherein:

(a) the external control section of the dielectric coupling prove support has a plurality of control configurations on its exterior surface which are correlated with angular probe orientation.

8. The waveguide polarization coupling assembly as set forth in claim 7, wherein:

(a) sensing and control means is associated with the surface configurations and is connected to a motor means for precisely controlling attitude of the probe assembly.

9. A waveguide polarization coupling assembly, comprising:

(a) a rectangular input waveguide element having a closed end, (b) a circular output waveguide element adjacent and connected to the rectangular input waveguide at one end and having its longitudinal axis perpendicular to and intersecting with that of the rectangular waveguide element, (c) a coaxial separator wall section disposed at the one end of the circular waveguide and between the rectangular and circular waveguide elements, (d) waveguide coupling means including a dielectric rotating member disposed within the circular waveguide element, (e) a metallic angular and longitudinally adjustable probe mounted in the rotating dielectric member for changing the plane of polarization within the actuator waveguide forming a magnetic loop coupling in the circular waveguide element, and a capacitive coupling with respect to the rectangular waveguide, (f) the dielectric rotating member extending through the rectangular input waveguide element and having a shoulder section extending outwardly therefrom, (g) the shoulder section being connected to a drive motor, and (h) the shoulder section having four attitude control surfaces separated from each other by ninety degrees, (i) electromechanical sensing means associated with the shoulder section surface for sensing ninety degrees changes in rotational attitude of the dielectric rotating member and controlling operation of the motor.

10. A waveguide polarization coupling assembly, comprising:

(a) a rectangular input waveguide element having a closed end, (b) a circular output waveguide element adjacent and connected to the rectangular input waveguide at one end and having its longitudinal axis perpendicular to and intersecting with that of the rectangular waveguide element, (c) a coaxial separator wall section disposed at the one end of the circular waveguide and between the rectangular and circular waveguide elements, (d) waveguide coupling means including a dielectric rotating member disposed within the circular waveguide element, (e) a metallic angular and longitudinally adjustable probe mounted in the rotating dielectric member for changing the plane of polarization within the circular waveguide forming a magnetic loop coupling in the circular waveguide element, and a capacitive coupling with respect to the rectangular waveguide, (f) mechanical means connected to the waveguide coupling means for providing accurate stepped 90° rotating motion thereto.

11. The waveguide polarization coupling assembly, as set forth in claim 10, wherein:

(a) the supported end of the metallic adjustable probe is spaced from the rear face of the rectangular waveguide.

12. The waveguide polarization coupling assembly, as set forth in claim 10, wherein:

(a) the adjustable probe has a short leg disposed within the circular waveguide element which is disposed parallel to the coaxial separator section and rotates in a plane parallel to the coaxial separator section.

13. The waveguide polarization coupling assembly, as set forth in claim 12, wherein:

(a) the probe is L-shaped.

14. The waveguide polarization coupling assembly, as set forth in claim 12, wherein:

(a) the probe is L-shaped and is mounted within a bore extending longitudinally through the rotating dielectric member in which its position can be adjusted so as to provide desired spacing between the short leg of the probe and the coaxial separator wall section.

* * * * *